United States Patent [19]

Baird, Jr. et al.

[11] 4,003,824

[45] Jan. 18, 1977

[54] DESULFURIZATION AND HYDROCONVERSION OF RESIDUA WITH SODIUM HYDRIDE AND HYDROGEN

[75] Inventors: William C. Baird, Jr.; Roby Beardon, Jr., both of Baton Rouge, La.

[73] Assignee: Exxon Research and Engineering Company, Linden, N.J.

[22] Filed: Apr. 28, 1975

[21] Appl. No.: 571,913

[52] U.S. Cl. ..... 208/108; 208/209; 208/230; 208/251 H; 208/264; 208/289; 252/439; 252/476

[51] Int. Cl.[2] ..... C01G 13/06; B01J 27/04

[58] Field of Search ..... 208/108–112, 208/230, 235, 209, 264, 208 R, 208 M, 226, 289

[56] References Cited

UNITED STATES PATENTS

| | | | |
|---|---|---|---|
| 1,729,943 | 10/1929 | Hofsass | 260/667 |
| 1,954,478 | 4/1934 | Egloff | 208/112 |
| 3,160,580 | 12/1964 | Achenbach et al. | 208/226 |
| 3,496,098 | 2/1970 | Rothe | 208/230 |
| 3,787,315 | 1/1974 | Bearden et al. | 208/208 M |
| 3,788,978 | 1/1974 | Bearden et al. | 208/208 M |
| 3,791,966 | 2/1974 | Bearden et al. | 208/208 M |

*Primary Examiner*—Herbert Levine
*Assistant Examiner*—G. E. Schmitkons
*Attorney, Agent, or Firm*—Edward M. Corcoran

[57] ABSTRACT

Sulfur-containing petroleum oil feedstocks which include heavy constituents undergo both desulfurization and hydroconversion by contacting such feedstocks with sodium hydride in the presence of hydrogen, at elevated temperatures. The mixture of reaction products resulting from the above procedure can be separated to give a petroleum oil product which has been desulfurized and demetallized and has a reduced Conradson carbon content and an increased API gravity relative to the feedstock, and a by-product of sodium sulfide salt.

17 Claims, 1 Drawing Figure

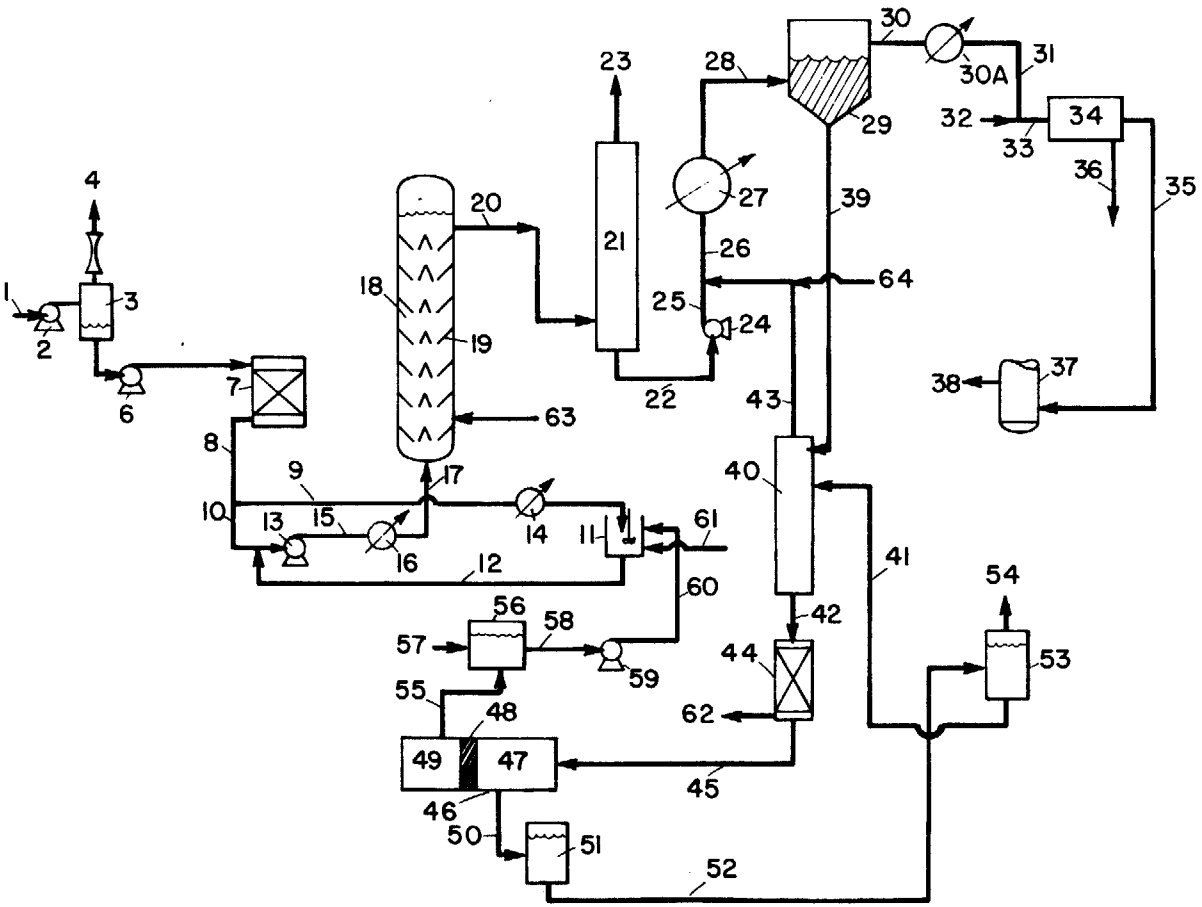
1
2
3
4
6
7
8
9
10
11
12
13
14
15
16
17
18
19
20
21
22
23
24
25
26
27
28
29
30
30A
31
32
33
34
35
36
37
38
39
40
41
42
43
44
45
46
47
48
49
50
51
52
53
54
55
56
57
58
59
60
61
62
63
64

DESULFURIZATION AND HYDROCONVERSION OF RESIDUA WITH SODIUM HYDRIDE AND HYDROGEN

FIELD OF THE INVENTION

This invention relates to the desulfurization, hydroconversion and consequent upgrading of sulfur-bearing hydrocarbon feedstocks by contacting the feedstock with sodium hydride in the presence of hydrogen and at elevated temperatures.

DESCRIPTION OF THE PRIOR ART

The problem of air pollution, particularly with regard to sulfur oxide emissions, has been of increasing concern to refiners. As a consequence, the development of efficient as well as economic means for the removal of sulfur from sulfur-bearing fuel oils has become a primary research goal. Presently, the most practical desulfurization process is the catalytic hydrogenation of sulfur containing molecules in petroleum hydrocarbon feeds to effect the removal of these sulfur molecules as hydrogen sulfide. The process generally requires relatively high hydrogen pressures, e.g., from about 700 to 3000 psig and temperatures in the range of about 650° F to 850° F depending on the feedstock and the degree of desulfurization. In addition, these catalytic desulfurization processes do not effect in significant degree the conversion of the feedstocks employed, but are utilized as an adjunct to such hydroconversion processes.

These catalytic processes are thus generally quite efficient in the handling of distillates, but become more complex and expensive and less efficient as the feedstock becomes increasingly heavier, e.g., whole or topped crudes and residua. Thus, for example, a residuum feedstock is often times contaminated with heavy metals, e.g., nickel, vanadium, iron, and asphaltenes which tend to deposit on and deactivate the catalyst. Also, the sulfur is generally contained in high molecular weight molecules that can be broken down only with the aid of severe operating conditions. When more severe operating conditions are employed, however, they result in the degredation of the hydrocarbon feedstock due to thermal cracking, e.g., through olefin and coke formation, thus accelerating catalyst deactivation.

It has been long known that sodium and other alkali metals and hydroxides exhibit desulfurization activity for residua, but even so suffer from distinct drawbacks. These include their poor desulfurization efficiency, a tendency to produce oil insoluble sludges, and an inability to upgrade the feedstock by demetallization, as well as the formation of salt-oil mixtures that are exceedingly difficult to resolve by conventional means. In addition, none of the prior art alkali metal desulfurization achieves the conversion of the hydrocarbon feedstocks being desulfurized. Recently, however, U.S. Pat. No. 3,788,978 disclosed new means for the resolution of desulfurized oil-sodium salt mixtures and U.S. Pat. No. 3,787,315 disclosed that sodium treatment in the presence of low pressure hydrogen improved sodium efficiency (i.e., the amount of sodium required to remove a given amount of sulfur), improved demetallization, and substantially reduced the amount of sludge formed therein. Again, however, this process did not effect the conversion of the feedstocks during their desulfurization therein.

It has also been suggested to employ sodium hydride as a desulfurization agent. For example, British Patent Specification No. 967,317 discloses the treatment of hydrocarbons, including oils, with finely divided alkali metal compounds such as sodium hydride and/or sodium oxide with or without hydrogen at temperatures ranging from 302° to 482° F, and under relatively low pressures, namely up to 15 atmospheres gauge. U.S. Pat. No. 1.954,478 discloses a process for the treatment of hydrocarbon oils with a metal hydride, including sodium hydride, in the presence of steam under super-atmospheric pressures ranging from 75 to 3000 lb., and at temperatures ranging from 400° to 1400° F, and optionally hydrogen. U.S. Pat. No. 3,496,098 discloses a process for desulfurizing and deodorizing hydrocarbon oils employing as a catalyst a finely divided sodium compound, namely sodium monoxide or sodium hydride supported on a mixed carrier of an alkaline earth metal oxide and carbon. The hydrocarbon oils are passed over the catalyst at temperatures ranging from 302° to 572° F. None of these processes, however, result in the combined desulfurization and hydroconversion of the petroleum feedstocks utilized.

It has now been found that where sodium hydride is employed in the presence of hydrogen to react with sulfur-bearing petroleum oil feedstocks, at elevated temperature, the feedstock undergoes both desulfurization and demetallization in addition to the hydroconversion of the heavy constituents of the feedstock to lighter, lower boiling components. Thus, in effect, the use of sodium hydride in conjunction with the hydrogen as described herein provides a combined and simultaneous desulfurization and hydroconversion function, which may be effected in an efficient and economical manner.

SUMMARY OF THE INVENTION

In accordance with the present invention, an efficient desulfurization, hydroconversion and feed upgrading process is provided, wherein sulfur-bearing petroleum oil feedstocks, for example, whole or topped crudes and residua containing heavy constituents are contacted while in the liquid phase, with sodium hydride and hydrogen at temperatures ranging from 500° to about 2000° F and wherein the hydrogen partial pressure is within the range of from about 500 to about 5000 psig. The reaction product produced as a result of the above procedure comprises a desulfurized, upgraded petroleum oil, and various sodium sulfide salts, for example, primarily $Na_2S$. In a preferred embodiment of the invention, the feedstock is contacted with sodium hydride at a temperature and under a hydrogen partial pressure in the upper extremes of the temperature and hydrogen partial pressure ranges set out above to provide substantial desulfurization and demetallization while simultaneously hydroconverting heavy constituents of the feedstock to lighter, lower boiling components.

DETAILED DESCRIPTION OF THE INVENTION

The process of this invention is generally applicable to any sulfur bearing feedstock. Thus, while the process is applicable to distillates, the process is particularly effective when utilized to treat heavy hydrocarbons, e.g., those containing residual oils. Preferably, therefore, the process of the invention is utilized for the treatment of whole or topped crude oils and residua. Crude oils obtained from any area of the world such as the Middle East, e.g., Safaniya, Arabian heavy, Iranian light, Gach Saran, Kuwait, et., the U.S. or Venezuelan, e.g. Laquinillas, Tia Juana, Bachaquero, etc., as well as heavy gas oils, shale oils, heavy catalytic cycle oils, tar sands or syncrudes derived from tar sands, coal oils, bitumen derived from tar sands, and asphaltenes, can be treated by the process of this invention. Additionally, both atmospheric residuum (boiling above about 650° F) and vacuum residuum (boiling above about 1050° F) can be treated. Preferably, the feedstock is a sulfur-bearing heavy hydrocarbon oil having at least about 10% of materials boiling above 1050° F, more preferably at least about 25% of material boiling above 1050° F.

The feedstock may be directly introduced into a contacting zone for desulfurization and hydroconversion without pretreatment. It is desirable, however, to desalt the feedstock in order to prevent NaC1 contamination of the sodium salt products of the desulfurization reaction. Desalting is well known in the refining industry and may be effected by the addition of small amounts of water to the feedstock to dissolve the salt followed by the use of electrical coalescers. The oil is then dehydrated by conventional means.

Sodium hydride can be charged in a granular form ranging from powders (100+ microns) to particles (14 to 35 mesh range) or may be blended in a powder form with the feedstock prior to charging. Powders are preferred, however, in order to maximize reaction rate and minimize the need for mechanical agitation beyond the point of initial blending of powders and feedstock. The sodium hydride may also be employed as a dispersion in a paraffinic oil or in a portion of the product oil produced from sodium hydride treating. Furthermore, the sodium hydride may be dispersed on a suitable support, such as coke, charcoal and the like to provide a well dispersed supported sodium hydride. Use of sodium hydride in this form permits operating the process of the invention with a fixed or fluidized bed of sodium hydride.

The amount of sodium hydride employed generally, may range from about 1 to about 15% by weight of the feedstock, and preferably from about 1 to about 10% by weight thereof, depending on the sulfur content of the feedstock. Thus, from about 1 to about 4 moles of sodium hydride per mole of sulfur in the feedstock can be employed, and preferably from about 2 to about 3 and more preferably from about 2 to about 2.5 moles of sodium hydride per mole of feed sulfur.

A hydrogen-containing gas is introduced into the contacting zone as either pure hydrogen (for example, from a steam reforming process) or as a diluted hydrogen gas stream (for example, that from refinery discard streams, e.g., subsequent to hydrotreating processes, gas effluent from cat cracker or reformer light ends streams, naphtha reformer recycle hydrogen streams, and the like).

Contact of the sodium hydride, hydrogen and the feedstock is carried out at reaction conditions designed to maintain the bulk of the feedstock, and preferably substantially all of the feedstock in the liquid phase and to effect desulfurization and hydroconversion of the feedstock. Thus, the reaction of the feedstock, sodium hydride and hydrogen can be carried out at a temperature within the range of from about 500° to about 2000° F, and under a hydrogen partial pressure within the range of from about 500 to about 5000 psig. In a preferred embodiment of the invention wherein it is desired to effect desulfurization and demetallization while simultaneously effecting substantial hydroconversion of heavy constituents of the feedstock to light, lower boiling components, the feedstock, sodium hydride and hydrogen are contacted at a temperature within the range of from about 500° to about 1500° F, and preferably within the range of from about 750° to about 1000° F under a hydrogen partial pressure of within the range of from about 1000 to about 5000 psig, and preferably within the range of from about 1500 to about 3000 psig. It thus will be noted that an increase in temperatures and increase in hydrogen partial pressures allows increasing hydrogen consumption by the feedstock with concomitant increasing quality including increased demetallization, substantial desulfurization, a substantial reduction of Conradson carbon content and a substantial increase in API gravity.

It will also be appreciated that the sodium hydride-hydrogen treating may be operated in a staged manner by successive treatments of feed with fresh charges of the sodium hydride and hydrogen.

Where it is desired to primarily desulfurize the feedstock with only modest hydroconversion thereof, the feedstock, sodium hydride, and hydrogen may be contacted at a temperature within the range of from about 500° F to about 750° F, and preferably within the range of from about 550 to 700° F under a hydrogen pressure within the range of from about 500 to about 1000 psig, and preferably within the range of from about 500 to about 900 psig.

Total system pressures may vary widely and will normally vary based on the feedstock to be treated, the reaction temperature, and the desired hydrogen partial pressure. Thus, for reduced crudes the minimum total pressure will be in the range of about 35 to 300 psig. For whole or topped crudes, minimum total pressures may range from about 500 to 600 in order to maintain the feedstock substantially in the liquid phase.

The desulfurization and hydroconversion can be conducted as a batch or continuous type operation. The apparatus used in carrying out the desulfurization and hydroconversion is of a conventional nature and can comprise a single reactor or multiple reactors equipped with shed rows or other stationary devices to encourage contacting; orifice mixers; efficient stirring devices such as mechanical agitators, jets of restricted internal diameter, turbomixers, and the like, or a packed bed.

The hydrocarbon feedstock and the sodium hydride can be passed through one or more reactors in concurrent, crosscurrent, or countercurrent flow, etc. It is preferable that oxygen and water be excluded from the reaction zones; therefore, the reaction system is normally purged with dry nitrogen and the feedstock dried prior to introduction into the reactor. It is understood that trace amounts of water, i.e. less than about 0.5 weight percent, preferably less than about 0.1 weight percent based on total feed, can be present in the reactor. The resulting oil dispersion is subsequently removed from the desulfurization zone and resolved by conventional means.

The salt product produced in the above reaction generally comprises sodium sulfide, or sodium hydrosulfide if hydrogen sulfide is employed to quench the reaction mixture, or other sodium-sulfur salt. The salt product is conveniently separated from the desulfurized feedstock by filtration, centrifugation, decantation, etc., and may be converted to sodium hydride by conventional electrochemical or chemical procedures.

DESCRIPTION OF THE DRAWINGS

The attached Figure is a flow diagram of a preferred embodiment of the overall desulfurization and hydroconversion process of the invention using sodium hydride and hydrogen.

Turning now to the accompanying Figure, a sulfur-containing feedstock preheated to between 400° and 700° F, is fed by means of line 1 and pump 2 to separator vessel 3 where trace amounts of water and light hydrocarbon fractions are removed through line 4. The feed is then discharged through line 5 by pump 6 to filter vessel 7 wherein particulate matter, i.e., coke, scale, etc., is removed.

The feed is preliminarily desalted by conventional means (not shown). Feed exiting the filter via line 8 is split into two streams. A small portion is fed through line 9 and heat exchanger 14 to vessel 11 where a dispersion is formed with sodium hydride formed from the reaction of sodium, entering from line 60, and hydrogen, introduced through line 61, (See description by Sittig in "Sodium, Its Manufacture, Properties, and Uses", Reinhold, New York, 1956, 202). The vessel is of a dispersator design, providing for high shear mixing, and is operated at from 400 to 700° F, at from 50 to 500 psig hydrogen, for holding times of from about ½ to 1 hour. Optionally, two or more reactors of like design can be substituted for the single vessel reactor, to provide for two staged and more nearly complete conversion of sodium to sodium hydride at the above specified conditions. The resultant dispersion, drawn through line 12, blends with the balance of the feed in line 10 and enters the charging pump 13, where the pressure is raised to about 1500 psig. The feedstock will ordinarily be a whole crude of about 1 to about 3 weight percent sulfur based on total feed or a residual stock of about 2 to about 7 weight percent sulfur based on total feed.

The feedstock enters heat exchanger 16 via line 15 where its temperature is raised to a temperature of from about 750 to 800° F, and the feedstock is then fed through line 17 to reactor vessel 18. The reactor contains baffles 19 to promote continuing contact between sodium hydride and the oil, and to prevent bypassing from the inlet to the outlet. Hydrogen is introduced into the reactor vessel 18 via line 53 in amounts such that the total partial pressure of hydrogen in the reactor preferably ranges from between about 1500 to 2500 psig. Holding time in the reactor is about 15 to 60 minutes and is preferably about 30 minutes. The temperature at the top of reactor 18 is about 850° F, but can range as high as 900° F.

Sodium sulfide — oil dispersion exiting reactor 18 via line 20 is introduced into stripper tower 21, where the pressure is lowered to approximately 100 psig. Light hydrocarbon products and excess hydrogen are withdrawn through line 23, and subsequently condensed and depressurized by conventional means (not shown). Hydrogen is recycled to the reactor and hydrocarbon products are directed to storage. The resultant oil-salt mixture is fed via line 22 and pump 24 to line 25 where contact is made with hydrogen sulfide entering through line 43 at from about 300 to 400 psig. The hydrogen sulfide rate is set to provide between about 110 and 150 mole percent hydrogen sulfide based on the entering moles of sodium salts. The hydrogen sulfide-treated mixture then enters heat exchanger 27 via line 26, when the mixture temperature is adjusted to about 700° to 750° F, and then through line 28 to separator vessel 29. At this point molten sodium hydrosulfide produced by the action of hydrogen sulfide on the sodium salts disengages. The separator vessel 29 is operated at between about 700° to 750° F, under from about 200 to 400 psig, for holding times on the order of about 10 minutes. Desulfurized oil is withdrawn via line 30 to heat exchanger 30A and exits at a temperature of between about 250° and 300° F, through line 31. An acid, such as dilute sulfuric acid or acetic acid, may then be injected into line 33 through line 32 to react with oil-soluble sodium salts, e.g., sodium mercaptides and the like, and the resultant mixture enters the electrostatic precipitator 34 via line 33. The acidic aqueous phase from vessel 34 is withdrawn through line 36 and discarded. Desulfurized oil is fed through line 35 to steam stripper 37 and subsequently to storage via line 38.

Molten sodium hydrosulfide withdrawn from separator vessel 29 via line 39 may be converted to sodium hydride by a sequence of reaction steps involving the formation of of metallic sodium and the reduction of sodium with hydrogen to form the hydride.

In one preferred embodiment, as shown in the drawing, sodium is produced by the electrolysis of a molten sodium polysulfide steam prepared by reacting the molten hydrosulfide with sulfur or sulfur-rich polysulfide. The electrolysis procedure, as well as the highly efficient electrolyic cell used, is described in considerable detail in U.S. Pat. Nos. 3,787,315 and 3,788,978, and these discussions therein are incorporated herein by reference thereto. Alternatively, the sodium hydrosulfide can be reacted with hydrogen chloride to provide the sodium chloride feed for the more conventional and commercially employed DOWNS CELL for electrolytic sodium manufacture, as described in U.S. Pat. No. 1,501,756, which is also incorporated herein by reference thereto; or the sodium hydrosulfide can be treated with $CO_2$ and steam to yield the carbonate, which can be subsequently reduced with carbon at elevated temperatures to yield sodium metal (for example see "Gmelin's Handbuch der anorgenischen Chemie," System-Nummer 21, Berlin, Verlag Chemie (1928) which is also incorporated herein by reference thereto).

Referring again to the preferred embodiment shown in the drawing, molten sodium hydrosuflide is fed through line 39 to blending vessel 40 where contact is made with a stream of sulfur rich sodium polysulfide, i.e., $Na_2S_{4.5}$ to $Na_2S_{4.8}$, entering via line 41. The blending vessel operates at approximately 50 psig and at about 700° F, with a holding time on the order of 10 to 30 minutes. Under those conditions, sodium hydrosulfide and the sulfur rich polysulfide react to form the preferred cell feed, the sodium tetrasulfide and hydrogen sulfide. The reaction is as follows, in equation form, in the case of reaction with $Na_2S_{4.5}$;

Preparation of Cell Feed $$2NaSH + 6\ Na_2S_{4.5} \rightarrow 7Na_2S_4 + H_2S$$

Hydrogen sulfide released in the reaction is recycled via line 43 to react with the oil-sodium salt reactor mixture, as described above. Makeup hydrogen sulfide is added through line 64. Molten sodium tetrasulfide is freed of any coke and insoluble salts, which are withdrawn through line 62, by feeding through filter vessel 44. Still molten at about 650° to 700° F, sodium tetrasulfide withdrawn through line 45, enters the anode compartment 47 of electrolytic cell 46, where under an applied voltage of from 2.5 to 4.0 volts sodium ions flow through a ceramic membrane of beta-alumina, 48, and are discharged in the cathode compartment, 49, as metallic sodium. The following equations represent the cathode and anode reactions for the maximum extent of electrolysis anticipated. i.e. conversion of sodium tetrasulfide to sodium pentasulfide;

ANODE $$S_4^{=} \rightarrow S_4^{\circ} + 2e^-$$

CATHODE $$2Na^+ + 2e^- \rightarrow 2Na$$

OVERALL $$5Na_2S_4 \rightarrow 4Na_2S_5 + 2Na$$

Molten sodium pentasulfide exiting anode compartment 47 via line 50 is fed to surge vessel 51 and then to pyrolyzer tower 53 via line 52, where under reduced pressure sulfur is removed from the sodium pentasulfide until the composition reaches $Na_2S_{4.5}$ to $Na_2S_{4.8}$. The vessel operates at a reduced pressure of about 50 to 100 mm Hg. and at temperatures ranging from about 700° to 800° F, with higher temperatures and lower pressures favoring the removal of sulfur. Sulfur vapor is removed through line 54 to storage. Molten sodium polysulfide of composition $Na_2S_{4.5}$ is recycled to vessel 40 via line 41. Molten sodium removed from cathode compartment 49 via line 55 is fed to surge tank 56 where makeup quantities of sodium are added through line 57. The sodium stream then enters charging pump 59 by way of line 58, and finally to vessel 11 via line 60 for reaction with hydrogen entering from line 61, as described above.

This invention is generally applicable to heavy crudes and residua feeds, including both the 650° F and 1050+° F fractions of feeds from Africa, North and South America and the Middle East. Inspection for the feedstock used in the examples is as follows:

| FEEDSTOCK INSPECTION | |
|---|---|
| Feed Designation | Sanfaniya |
| 1050-, Vol. % | 59 |
| API Gravity | 14.4 |
| Sulfur, Wt. % | 4.0 |
| Nitrogen, Wt. % | 0.26 |
| Carbon, Wt. % | 84.42 |
| Hydrogen, Wt. % | 11.14 |
| Oxygen, Wt. % | 0.28 |
| Conradson Carbon, Wt. % | 12.1 |
| Asphaltene, Wt. % | 13.0 |
| Metals, ppm | |
| Ni | 20 |
| V | 77 101 |
| Fe | 4 |
| Viscosity | |
| VSF 122° F | 235 |
| 144° F | 130 |
| Pour Point, ° F | 33 |
| Naphtha Insolubles, Wt. $ | 7 |
| R.I. 67° C. | |
| Flash Point, ° F | 318 |

Sodium hydride-treated oil products were analyzed not only for sulfur content, but also for changes in metal content and general physical properties such as API gravity, and Conradson carbon.

EXAMPLES 1 to 4

The data shown below in Table I demonstrate the effect of hydrogen pressure on desulfurization and hydroconversion of the above feed with sodium hydride.

TABLE I

THE EFFECT OF HYDROGEN PRESSURE AND OPERATING TEMPERATURE batch tests - treatment of Safaniya Atmospheric Residuum Feed

| EXAMPLE NO. | CONTROL A | 1 | 2 | 3 |
|---|---|---|---|---|
| Residuum g. | 99.2 | 99.7 | 91.6 | 1.03 |
| Sodium hydride, Wt. % feed | 6 | 6 | 6 | 6.6 |
| Hydrogen psig | 0 | 500 | 600 | 1500 |
| Temp. ° F | 700 | 700 | 700 | 820 |
| Run Time hr. | 1 | 2 | 1 | 1 |
| Residuum Product Analysis | | | | |
| Sulfur, Wt. % | 1.1 | 1.0 | 1.0 | 0.2 |
| Metals Ni/V/Fe(ppm) | 13/29/0 | 5/9/1 | 7/10/1 | 2/5/3 |
| Coke, Wt. % | 0.4 | 0 | 0.2 | 0.3 |
| Conradson Carbon, Wt. % | 9.2 | 7.4 | 6.3 | 5.0 |
| API Gravity | 19.2 | 19.8 | 20.8 | 27.2 |
| Desulfurization % | 70 | 75 | 75 | 89.6 |
| Demetallization % | 62 | 86 | 84 | 89.4 |
| Conradson Carbon Removal % | 23.7 | 38.8 | 47.5 | 60.0 |
| 1050⁻, Vol. % | — | 65 | — | 92 |

It is seen from the data of Table I that where increased hydrogen pressures and operating temperatures are employed, the hydroconversion activity increases as reflected by the greatly increased API gravity and the degree of 1050⁻ distillate of the products of Example 3 as opposed to the products of Examples 1 and 2 and that of Control A.

EXAMPLE 4

The data shown in Table II demonstrate the effect of reaction time on desulfurization and hydroconversion.

TABLE II

THE EFFECT OF REACTION TIME (BATCH TESTS AT 700° F - TREATMENT WITH SAFANIYA ATMOSPHERIC RESIDUUM WITH SODIUM HYDRIDE AND 500 PSIG HYDROGEN)

| EXAMPLE NO. | 4 | 5 |
|---|---|---|
| Reactants | | |
| Residuum g. | 97.1 | 99.7 |
| Sodium hydride Wt. % feed | 6 | 6 |
| Hydrogen, psig | 500 | 500 |
| Reaction period, hr. | 0.5 | 1 |
| Residuum Product Analysis | | |
| Sulfur Wt. % | 1.1 | 1.0 |
| Metals Ni/V/Fe(ppm) | 7/10/1 | 5/9/1 |
| Coke Wt. % | 0 | 0 |
| Conradson Carbon, Wt. % | 7.2 | 7.4 |
| Desulfurization, % | 73 | 75 |
| Demetallization, % | 84 | 86 |
| Conradson Carbon Removal, % | 40 | 38.8 |
| API Gravity | 19.9 | 19.8 |

As seen in Table II, Examples 4 and 5, demonstrate that the sodium hydride process of the invention is not particularly sensitive to reaction period, and a holding time or space velocity suited to the conversion level desired may be selected.

EXAMPLE 6

The data set out in Table III below demonstrate the effect of carrying out the process of the invention in a staged manner by successive treatments of the feed with fresh charges of sodium hydride and hydrogen.

TABLE III

EFFECT OF CARRYING OUT PROCESS WITH SAFANIYA ATMOSPHERIC RESIDUUM IN A STAGED MANNER

| Reactants | Stage 1 | Stage 2 | |
|---|---|---|---|
| Residuum, g. | 128.5 | 88.3 | |
| Reagent, g., Wt. % | NaH 7.8,6.1 | NaH 7.8,6.1 | |
| Hydrogen, psig, Initial | 500 | 500 | |
| Reaction Conditions | | | |
| Time, hr. | 1 | 1 | |
| Temp., ° F. | 700 | 700 | |
| Product Inspections | | | |
| Sulfur, Wt. % | 1.05 | 0.67 | |
| Nitrogen, Wt. % | — | 0.24 | |
| Conradson Carbon, Wt. % | — | 7.3 | |
| Ni-V/Fe, ppm | — | 5/1/2 | |
| API Gravity | 20.0 | 22.4 | |
| Desulfurization, % | 73.0 | 36.1 | (overall desulfurization 83.0%) |
| Conradson Carbon Loss % | — | 39.7 | |
| Demetallization, % | — | 93.0 | |
| Products Recovered | | | |
| Liquid, Wt. % on feed | 96.7 | 97.2 | |
| Coke, Wt. % on feed | 0 | 0 | |
| $C_4$-Gas, Wt. % on feed | 0.2 | 0.2 | |

The data in Table III demonstrate that desulfurization can be increased by successive treatment of the feed with fresh charges of sodium hydride and hydrogen. This will be seen in comparing desulfurization of 75% in Stage 1 with the overall desulfurization of 83.0% in Stage 2.

What is claimed is:

1. A process for the desulfurization and hydroconversion of a sulfur-containing heavy petroleum oil feedstock containing at least 10 wt.% of components boiling above 1,050° F, which comprises contacting said sulfur-containing petroleum oil feedstock with sodium hydride at elevated temperatures in the presence of hydrogen, the hydrogen providing a hydrogen partial pressure within the range of from about 500 to about 5000 psig, said feedstock being maintained substantially in the liquid phase, to form an oil phase having a reduced sulfur content and a reduced Conradson carbon content, and a salt phase.

2. The process as defined in claim 1 wherein said feedstock, sodium hydride, and hydrogen are contacted at a temperature within the range of from about 500° to about 1500° F.

3. The process as defined in claim 2 wherein said feedstock, sodium hydride, and hydrogen are contacted at a temperature within the range of from about 750° to about 1000° F and the hydrogen provides a hydrogen partial pressure within the range of from about 1500 to about 3000 psig.

4. The process as defined in claim 2 wherein said feedstock, sodium hydride, and hydrogen are contacted at a temperature within the range of from about 500° to about 750° F, and the hydrogen provides a hydrogen partial pressure within the range of from about 500 to about 1000 psig.

5. The process as defined in claim 1 wherein the molar ration of sodium hydride to sulfur content of said feedstock is within the range of from about 2 to about 2.5 moles per mole of sulfur.

6. The process as defined in claim 1 wherein said sodium hydride is present in an amount within the range of from about 1 to about 15% based on the weight of said feedstock.

7. The process as defined in claim 1 wherein said salt phase comprises a sodium sulfur salt.

8. The process as defined in claim 7 wherein said sodium sulfur salt comprises sodium sulfide.

9. The process as defined in claim 8 wherein hydrogen sulfide is added to a mixture of said oil phase and said salt phase to convert said sodium sulfide to sodium hydrosulfide.

10. The process as defined in claim 1 including the step of separating said oil phase from said salt phase, said salt phase comprising a sodium sulfide salt.

11. The process as defined in claim 10 including the step of converting said sodium sulfide salt to sodium hydride and recycling said sodium hydride.

12. The process as defined in claim 1 which includes containing at least a portion of said salt phase with a sulfur-rich polysulfide, thereby forming a sulfur-depleted polysulfide, electrolyzing at least a portion of said sulfur-depleted polysulfide, thereby producing sodium, and contacting said sodium with hydrogen, thereby producing sodium hydride.

13. The process of claim 12 wherein said sulfur-rich polysulfide is represented by the formula $Na_2S_x$, where $x$ has a value of from about 4.0 to 4.8, and said sulfur-depleted sodium polysulfide is represented by the formula $Na_2S_y$, where y has a value of from about 3.0 to 4.3.

14. The process of claim 12 wherein said sulfur depleted polysulfide is electrolyzed in an electrolytic cell including an anodic compartment containing said polysulfide ions and a cathode compartment containing said sodium metal, said anodic and cathodic compartments separated by a sodium ion conducting membrane comprising beta-alumina.

15. The process as defined in claim 1 further including the step of contacting said oil phase with additional quantities of sodium hydride and hydrogen.

16. The process of claim 2 wherein the feedstock contains at least 25 wt.% of components boiling above 1,050° F.

17. A process for the simultaneous desulfurization, demetallization and hydroconversion of a sulfur-containing heavy petroleum oil feedstock containing at least 10 wt.% of components boiling above 1,050° F, which comprises contacting said feedstock with sodium hydride in a conversion zone at a temperature ranging from 500° to 1,500° F in the presence of hydrogen, the hydrogen providing a hydrogen partial pressure within the range of from about 500 to about 5,000 psig, said feedstock being maintained substantially in the liquid phase in said conversion zone, to form an oil phase having reduced sulfur, metals and Conradson Carbon content and a salt phase, said salt phase comprising sodium sulfide, separating said oil phase from said salt phase and converting said sodium sulfide salt to sodium hydride and recycling said sodium hydride back to said conversion zone.

* * * * *